United States Patent [19]

Kuriyama et al.

[11] Patent Number: 4,631,825

[45] Date of Patent: Dec. 30, 1986

[54] WASHABLE ELECTRIC SHAVER

[75] Inventors: Shunichi Kuriyama; Yasuo Mitani, both of Hyogo, Japan

[73] Assignee: Sanyo Electric Co., Ltd., Japan

[21] Appl. No.: 702,492

[22] Filed: Feb. 19, 1985

[30] Foreign Application Priority Data

Feb. 20, 1984 [JP] Japan ..... 59-30731

[51] Int. Cl.[4] ..... B26B 19/10

[52] U.S. Cl. ..... 30/43.92; 30/34.1; 30/43.91; 30/41

[58] Field of Search ..... 30/34.1, 41, 43, 43.1, 30/43.8, 43.91, 43.92

[56] References Cited

U.S. PATENT DOCUMENTS

| | | | |
|---|---|---|---|
| 3,091,850 | 6/1963 | Kleinman | 30/43.1 |
| 3,748,730 | 7/1973 | Bartram et al. | 30/43.1 |
| 3,783,508 | 1/1974 | Brown et al. | 30/43.92 |
| 4,031,617 | 6/1977 | Tanaka et al. | 30/43.92 X |
| 4,184,088 | 1/1980 | Richert | 30/43.92 X |
| 4,426,776 | 1/1984 | Kakumoto et al. | 30/41 X |
| 4,442,596 | 4/1984 | Nasu et al. | 30/41 X |

*Primary Examiner*—E. R. Kazenske
*Assistant Examiner*—Willmon Fridie, Jr.
*Attorney, Agent, or Firm*—Darby & Darby

[57] ABSTRACT

A washable electric shaver apparatus an outer blade frame of which is mounted on the top of the shaver so as to be movable by a limited distance away in parallel from the top of an outer casing in response to the depression of a pair of releasable push buttons mounted on opposite sides of the outer casing. A gap is formed between the outer blade frame and the top of the outer casing as a result of such movement of the outer blade frame relative to the outer casing, so that shavings accumulated around an inner blade member can completely be removed away through the gap when washing the shaver in water.

12 Claims, 9 Drawing Figures

WASHABLE ELECTRIC SHAVER

FIELD OF THE INVENTION

This invention relates to an electric shaver apparatus, and more particularly to a washable electric shaver apparatus in which its outer blade frame is adapted to be moved a limited distance away in parallel from the top of an outer casing to form a gap therebetween, so that shavings can be washed away in water through the gap.

DESCRIPTION OF THE PRIOR ART

A known washable electric shaver apparatus is disclosed in, for example, Japanese Patent Early Publication No. 58-29479 (1983). According to the disclosed electric shaver apparatus, an outer blade frame is pivoted to one side of a body casing by a hinge member so that it can be swung to its open position to expose an inner blade member. The shaver apparatus with its inner blade member exposed is immersed in water, and the inner blade member is driven in water to remove shavings accumulated therearound. Another washable electric shaver apparatus is disclosed in, for example, Japanese Patent Early Publication No. 55-130695 (1981). According to the disclosed shaver apparatus, water-inlet ports normally closed by plugs are provided on opposite sides of an outer blade frame. The shaver apparatus is immersed in water with the plugs removed from the water-inlet ports to open the ports, and an inner blade member is driven for reciprocating movement in water to remove shavings accumulated around the inner blade member as well as shavings accumulated around the outer blade frame.

However, the former shaver has been defective in that the fingers of the user may sometimes be injured by the inner blade member externally exposed during washing, and, also, possible contact of the oscillating inner blade member with the inner surface of a washing vessel may cause breaking of some of its small blades resulting in impossibility of further use. The latter shaver has also been defective in that the small diameter of the water-inlet ports, through which shavings are discharged, gives rise to difficulty of complete discharge of shavings during washing, and shavings tend to clog the water-inlet ports resulting in impossibility of later washing.

SUMMARY OF THE INVENTION

It is a primary object of the present invention to provide a washable electric shaver apparatus which ensures safe washing without the possibility of injury of the fingers of the user and without the possibility of damage to the inner blade member and which can effectively remove shavings by washing in water.

In accordance with the present invention, there is provided a washable electric shaver apparatus comprising a generally cylindrical outer casing having a compartment for accommodating a motor, a cover member cooperating with an upper part of said outer casing to define a space for watertightly enclosing an oscillator operatively connected to the drive shaft of said motor, an inner blade member mounted on the top of an oscillating rod of said oscillator extending watertightly through said cover member, and an outer blade frame carrying an outer blade member arranged for making sliding engagement with the outer edges of a plurality of small inner blades of said inner blade member, said apparatus further comprising outer blade frame retaining means provided at opposite sides of the upper part of said outer casing so as to retain said outer blade frame relative to the outer casing, biasing means for normally resiliently biasing said outer blade frame in a direction away in parallel from the upper part of said outer casing, releasing means for releasing said outer blade frame in relation to said outer casing, and motion restricting means for limiting the movement of said outer blade frame away from the upper part of said outer casing, whereby when said outer blade frame is moved away from the upper part of said outer casing, a gap for washing in water is formed between said outer blade frame and the upper part of said outer casing.

Therefore, the shaver apparatus of the present invention can be effectively washed in water when so required, and the washing operation can be carried out quite safely, since the shaver apparatus is washed in the state in which its inner blade member is covered with the outer blade frame.

Preferably, said outer blade frame retaining means comprises a pair of bosses each formed on the inner wall of said outer blade frame, and a pair of recesses formed on the outer walls of a pair of pop-up arms, respectively, each recess being engageable with said boss, said pop-up arms being movable relative to said outer casing to cause said outer blade frame to move away from the upper part of said outer casing.

Preferably, said biasing means comprises said pop-up arms provided in pair, and a pair of coil springs interposed between said pop-up arms and associated portions of the upper end of said outer casing respectively, and said releasing means are actuated by the depression of a pair of releasing push buttons disposed on opposite side wall portions, respectively, of the upper part of said outer casing to be resiliently attached to the opposite ends, respectively, of said cover member. Preferably, said motion restricting means comprises the upper walls of inwardly protruding flanges of said pop-up arms and the lower walls of outwardly protruding flanges of upwardly protruding portions extending from the opposite ends of said cover member.

Preferably, the washable electric shaver apparatus of the present invention further comprises trimmer means disposed between said outer blade frame and the upper part of said outer casing, said trimmer means comprising a timmer mounting section which is the upward extension of said outer casing and is positioned laterally of said cover member, a trimmer coupler mounted between said trimmer mounting section and said cover member which is vertically movable between a trimmer operating position and a trimmer non-operating position, a trimmer handle mounted on said trimmer mounting section with a portion of said trimmer coupler interposed therebetween for causing the vertical movement of said trimmer coupler, a trimmer mounting frame fixed on the upper surface of said cover member, and a trimmer member mounted on said trimmer mounting frame and operatively connected to said trimmer coupler so as to be capable of making swinging movement between the trimmer operating position and the trimmer non-operating position according to the vertical movement of said trimmer coupler. Preferably, said trimmer member comprises a stationary blade, a movable blade cooperating with said stationary blade, and a coupling lug arranged to extend through a window formed in said trimmer mounting frame, said coupling lug being engageable with a trimmer coupling member formed on the oscillating rod of said oscillator, when said trimmer member is brought to its trimmer operating position.

According to the position and construction of the trimmer included in the electric shaver apparatus of the present invention, water can freely flow through the window of the trimmer mounting frame during the process of washing the electric shaver apparatus. Therefore, the necessary parts of the electric shaver apparatus including the trimmer can be easily washed for effectively removing shavings by the stream of water.

Preferably, said outer casing of the electric shaver apparatus of the present invention includes a battery accommodation compartment watertightly connected to said motor accommodation compartment and having an opening in its lower end, and said opening of said battery accommodation compartment is hermetically closed by an end cover of duplex structure composed of an inner cover member and an outer cover member fitted to each other in watertight relation, said inner cover member having a small hole used for a watertightness test, and said outer cover member having a mating projection normally plugging said small hole of said inner cover member.

According to the above construction of the outer casing, the opening of the battery accommodation compartment is openably, hermetically closed by the end cover of duplex structure including the inner cover member fitted in the outer cover member. Also, the small port formed in the inner cover member for watertightness test purpose is completely shielded by the outer cover member to be not viewable from outside, so that the user may not have suspicion about the presence of such a hole.

DESCRIPTION OF THE PREFERRED EMBODIMENT

Figure 1:
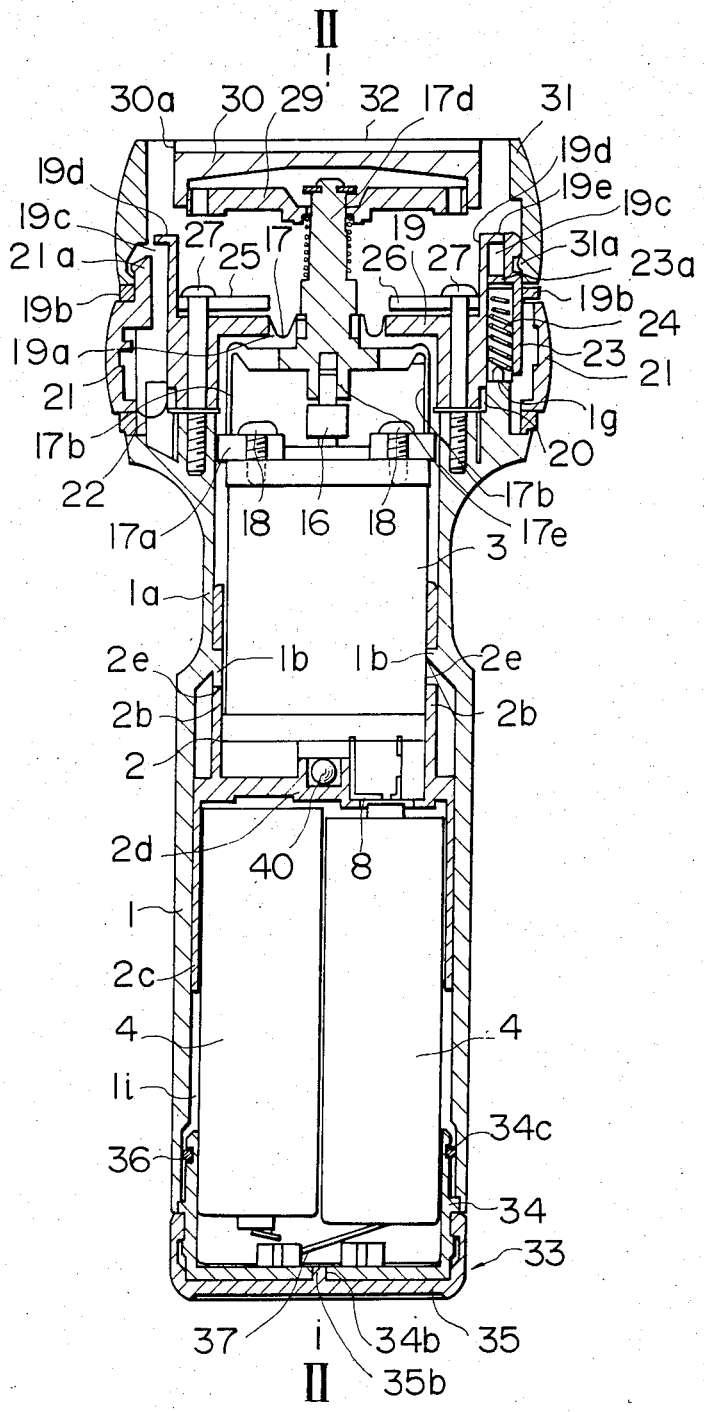
FIG. 1 is a longitudinal sectional view of a preferred embodiment of an electric shaver apparatus according to the present invention, but the sections at upper portions being taken slightly offset relative to each other for the purpose of explanation.

Referring now to the drawings, a generally cylindrical outer casing 1 is made of an ABS resin and has an indented portion 1*a* at a position slightly spaced from its upper end. The outer casing 1 is open at its upper and lower ends and defines a battery accommodation compartment 1*i* in its lower internal space. A battery casing 2 is press-fitted in the outer casing 1, and a DC motor 3 driven by two dry batteries 4 is accommodated in a motor accommodation compartment of the outer casing 1.

Figure 2:
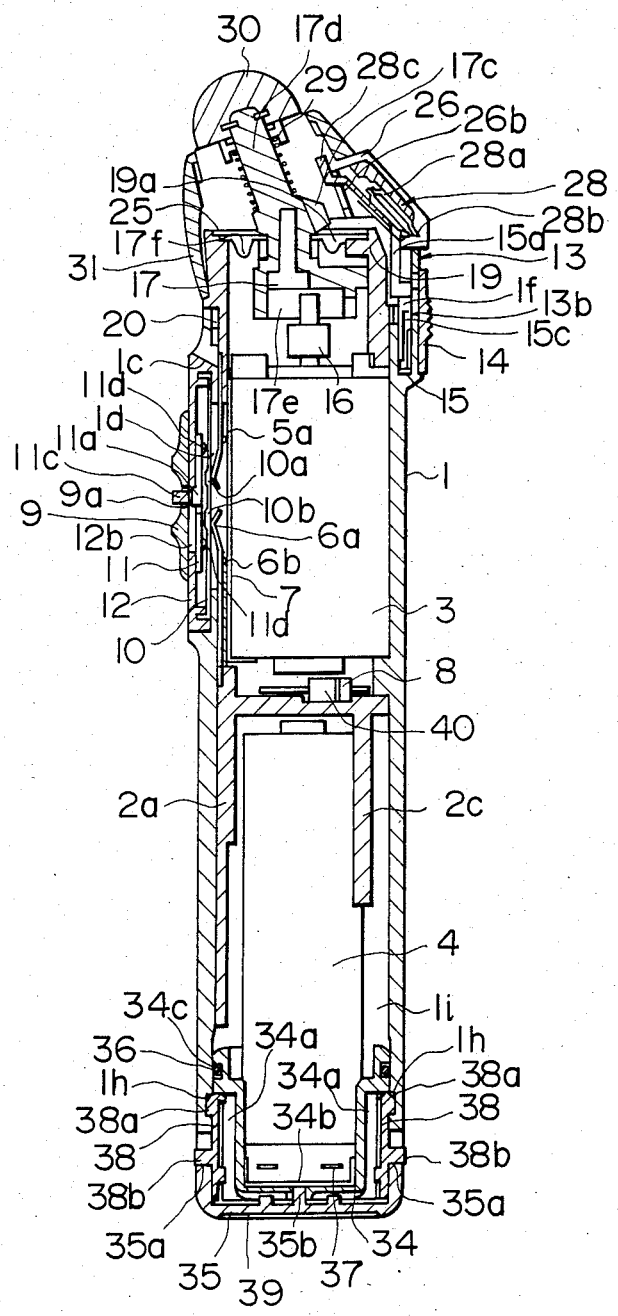
FIG. 2 is a sectional view taken along the line II–II' of FIG. 1.
Figure 3:
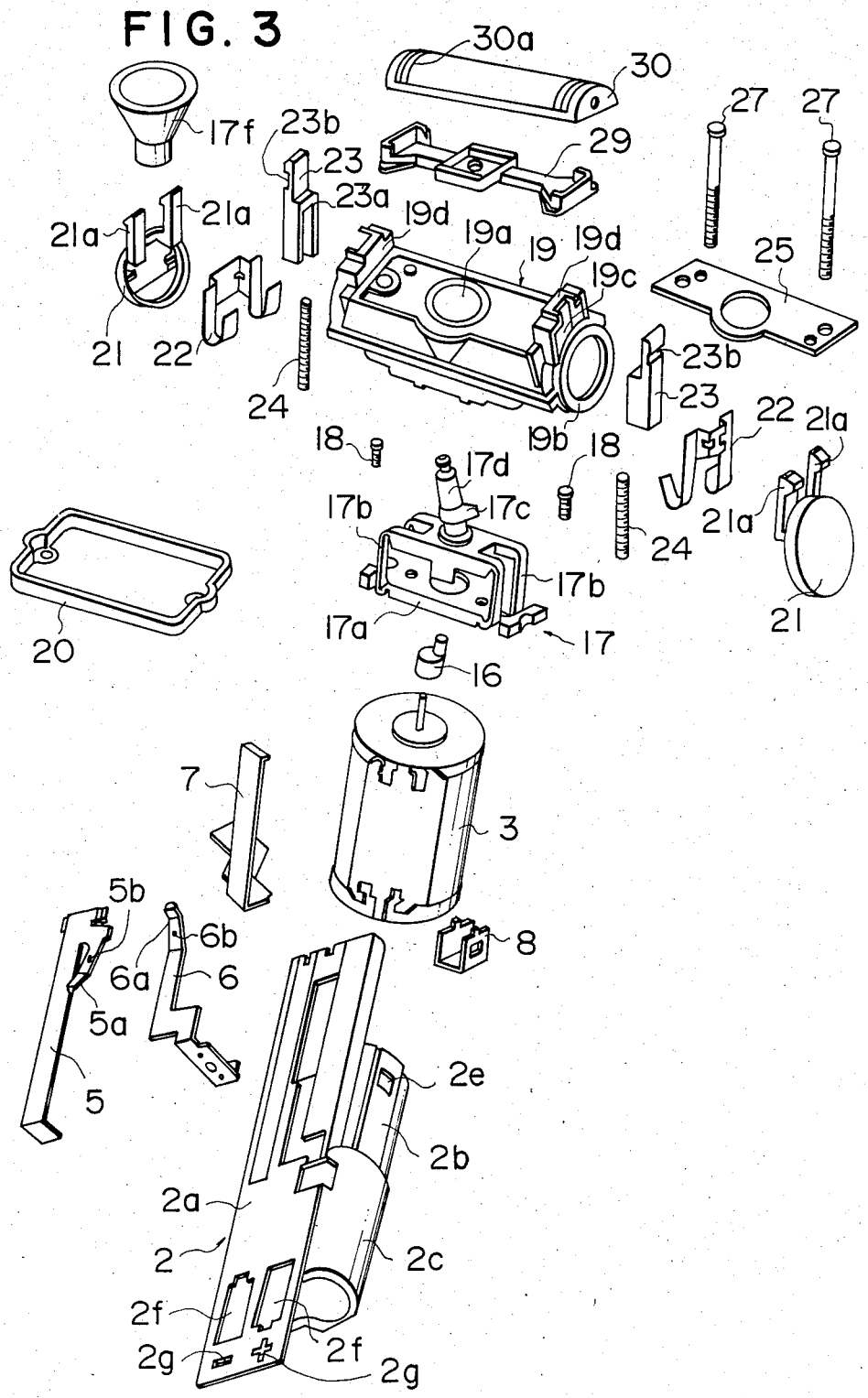
FIG. 3 is an exploded perspective view showing various parts contained in the outer casing of the electric shaver apparatus.

Referring to FIGS. 1, 2 and 3, the battery casing 2 includes a generally rectangular base 2*a*. A pair of arm portions 2*b* for holding the motor 3 and a cylindrical portion 2*c* for holding the batteries 4 are integrally formed with the base 2*a*, and separated by a motor-mounting seat portion 2*d*. A Schottky diode 40 is buried in this seat portion 2*d*. Lead strips 5 and 6 having respective switch contact strips 5*a* and 6*a* at one end thereof, as shown in FIG. 3, are fixed on the base 2*a* to turn on/off the electrical connection between the motor 3 and the batteries 4. It will be clear in FIG. 2 that when any one of the switch contact strips 5*a* and 6*a* is urged toward a conductive strip 7 from the position shown in the figure, its contact 5*b* or 6*b* makes electrical contact with the conductive strip 7 to establish a conduction path, the strip being mounted on one wall of the motor 3 and an end of the strip being connected to one of the terminals of the motor 3. A conductive member 8 is connected to the other terminal of the motor 3. A pair of perforations 2*e* are formed in the arm portions 2*b* of the cell casing 2. A pair of projections 1*b* (FIG. 1) engageable with the perforations 2*e* are formed on the inner side wall of the outer casing 1.

Figure 4:
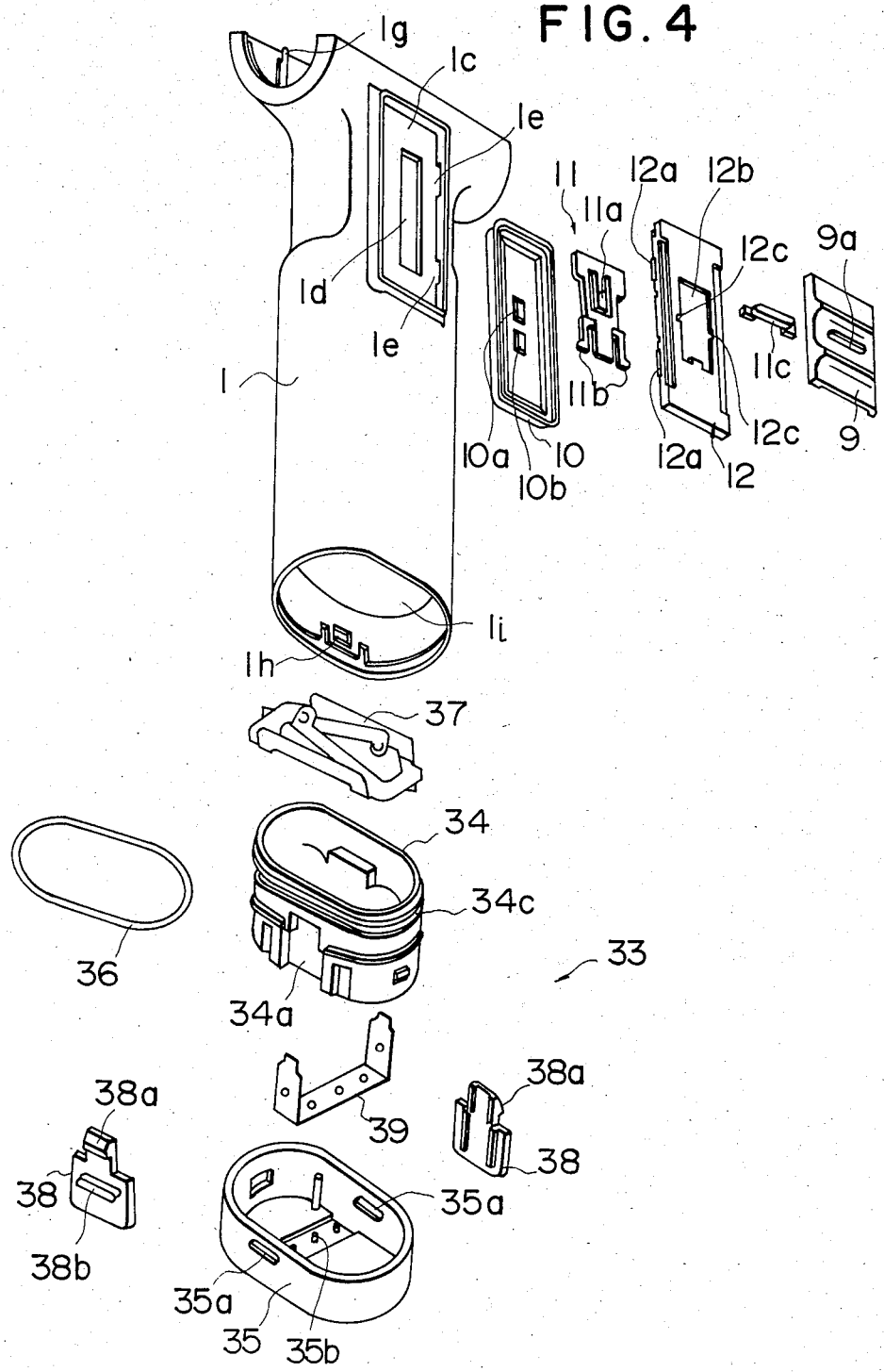
FIG. 4 is an exploded perspective view showing various parts contained in the bottom portion of the outer casing and various parts constituting the starter switch.
Figure 5:
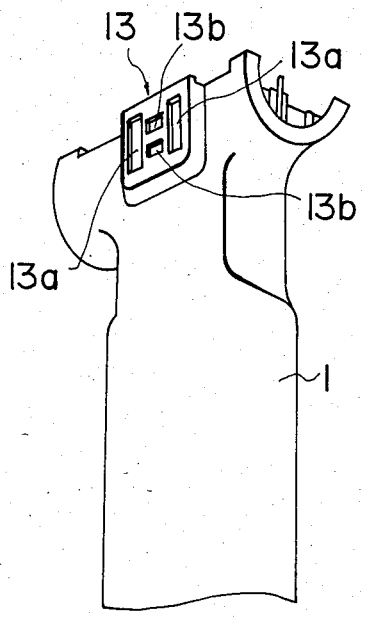
FIG. 5 is a perspective view showing the trimmer switch mounting section provided on the rear wall of the outer casing of the electric shaver apparatus.
Figure 6:
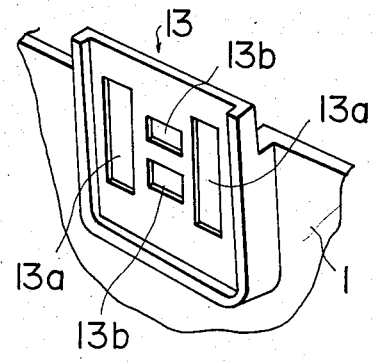
FIG. 6 is an enlarged perspective view of part of FIG. 5.

Referring to FIGS. 2 and 4, a switch knob 9 is slidably provided on the front wall of the outer casing 1. This switch knob 9 is mounted at a switch mounting section 1*c*, which is provided on the front wall of the outer casing 1, to cooperate with a dish-shaped rubber member 10, a click acting member 11, a retaining sheet 12 and a locking member 11*c*. The dish-shaped rubber member 10 is formed on its outer surface with a pair of spaced small projections 10*a* and 10*b* which are disposed at positions engageable with the respective switch contact strips 5*a* and 6*a* through an elongate slot 1*d* formed at the center of the switch mounting section 1*c*. The click acting member 11 is cut out at its substantially middle portion to form a resilient tongue 11*a*. The member 11 is also formed on its both sides with a pair of legs 11*b* and on its rear surface a pair of spaced pressurizing projections 11*d*. The retaining sheet 12 is formed on its both sides with a pair of anchoring projections 12*a*. The sheet 12 has a central cut-out 12*b* and is formed at its inner surface with a pair of lugs (not shown) disengageably engaging with the legs 11*b* of the click acting member 11. The switch mounting section 1*c* is formed on its outer wall with a pair of spaced recesses 1*e* for receiving the anchoring projections 12*a* of the retaining sheet 12, so that the sheet 12 is fixed to the outer casing 1 by engagement of the anchoring projections 12*a* with the recesses 1*e*. The locking member 11*c* is resiliently supported by the resilient tongue 11*a* through the cut-out 12*b* of the sheet 12 and is detachably positioned in a pair of opposing recesses 12*c* formed as part of the cut-out 12*b*. The switch knob 9 is formed at its middle portion with a slit 9*a* through which the locking member 11*c* is supported. The locking member 11*c* is formed at its both ends with a pair of engaging shoulders which engage with the peripheral edges of the cut-out 12*b* of the retaining sheet 12 so that it is slidable along and engages with the opposing recesses 12*c* to constitute a locking mechanism.

Figure 8:
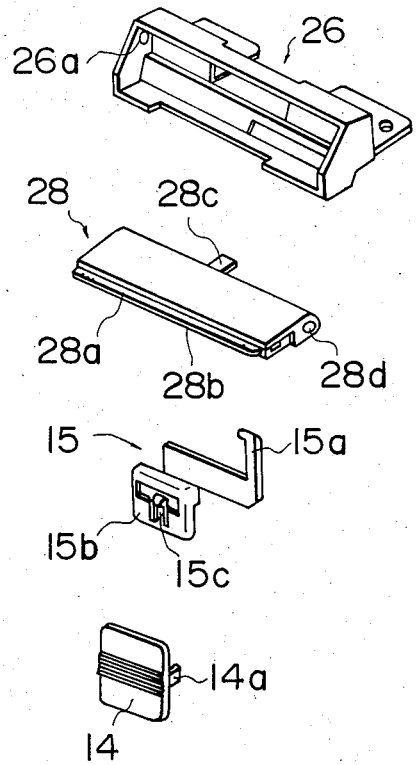
FIG. 8 is an exploded perspective view of parts constituting a trimmer.
Figure 7:
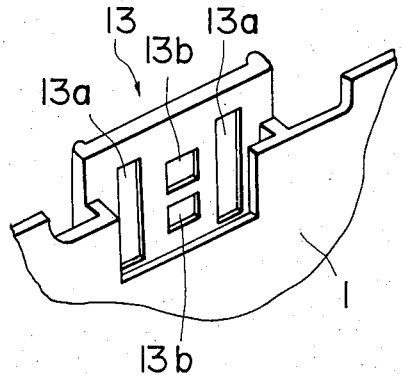
FIG. 7 is a rear perspective view of FIG. 6.

A trimmer switch mounting section 13 is provided on the rear wall of the outer casing 1. This trimmer switch mounting section 13 is formed with a pair of longitudinal slots 13*a* and a pair of small perforations 13*b*. This trimmer switch mounting section 13 slightly protrudes outward from the rear wall of the outer casing 1 to define a space 1*f* therebetween (FIGS. 2 and 5 to 8). A trimmer handle 14 is connected to the trimmer switch mounting section 13 by a trimmer connector 15. The trimmer handle 14 is provided with a pair of engaging pawls 14*a* as seen in FIG. 8, and these pawls 14*a* are slidably received in the associated slots 13*a* of the trimmer mounting section 13. On the other hand, the trimmer connector 15 includes an actuating arm 15*a* and a click acting member 15*b*, which is formed with a tongue 15*c* disengageably engaging the small perforations 13*b*.

Referring specifically to FIGS. 1 and 3, an eccentric cam pin 16 is mounted on the drive shaft of the motor 3, and an oscillator 17 is fixed by screws 18 to the upper part of the motor 3. The oscillator 17 includes a mounting seat 17*a*, thin-walled legs 17*b*, and an oscillating rod 17*d* provided with a trimmer coupling member 17*c* and has a recess 17*e* loosely receiving the eccentric cam pin 16 therein. A cover member 19 is mounted through a generally annular packing 20 on the open upper end of the outer casing 1 to seal this open upper end. This cover member 19 has a central hole 19*a* and is formed at its opposite ends with a pair of annular frame portions 19*b*. The cover member 19 is formed, as upper extensions of these annular frame portions 19*b*, with a pair of projections or supporting ribs 19*d* having outwardly protruding flanges 19*e* forming convex recesses 19*c*.

Also, referring specifically to FIGS. 1 and 3, a pair of releasing push buttons 21 are fitted in the annular frame portions 19*b* of the cover member 19 for releasing an outer blade frame 31 when depressed. Each of these buttons 21 has a pair of anchoring arms 21*a* formed integrally therewith for releasably holding the outer blade frame 31. These anchoring arms 21*a* are mounted in the recesses 19*c* together with springs 22 and pop-up arms 23 for popping up the outer blade frame 31. The releasing push buttons 21 are normally biased toward the annular frame portions 19*b* by springs 22.

A pair of coil springs 24 are received in inwardly protruding flanges 23*a* of the pop-up arms 23 and the pop-up arms 23 are disposed between the anchoring arm pairs 21*a* in the recesses 19*c*. A pair of spring-holding ribs 1*g* are formed at the upper end of the outer casing 1 to hold the coil springs 24 between the ribs 1*g* and the upper portions of the flanges 23*a*, thereby normally biasing the pop-up arms 23 upward in FIG. 1. The upper portions of the flanges 19*e* of the projections or ribs 19*d* of the cover member 19 abut the upper portions of the flanges 23*a* of the pop-up arms 23 during the upward movement of the pop-up arms 23, thereby functioning as a stopper or motion restricting means limiting the upward movement of the pop-up arms 23.

Figure 9:
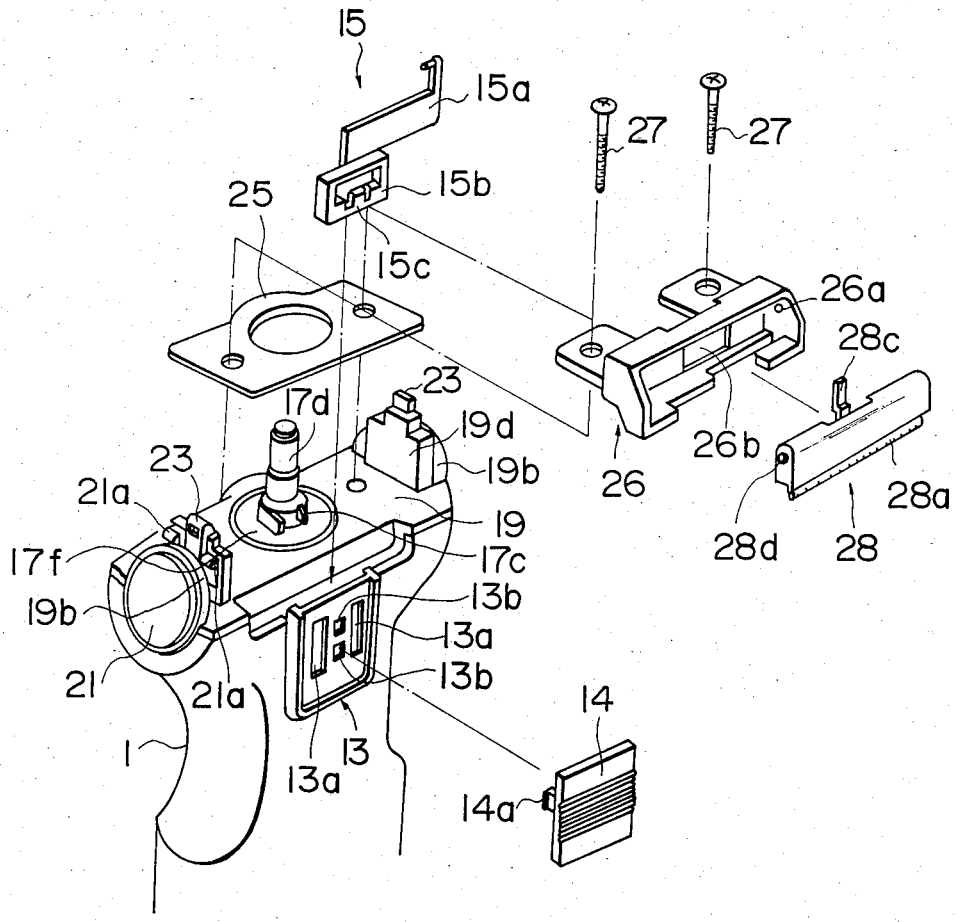
FIG. 9 is a perspective view illustrating the manner of mounting the trimmer in position.

Referring specifically to FIGS. 1, 2, and 9, a packing holding member 25 is placed on the upper surface of the upper cover 19. A packing 17*f* mounted on the oscillating rod 17*d* of the oscillator 17 protrudes upward together with the oscillating rod 17*d* through the circular opening 19*a* and is firmly held at its flanged portion between the packing holding member 25 and the upper surface of the upper cover 19.

Referring specifically to FIGS. 2 and 9, a trimmer mounting frame 26 is mounted by elongate screws 27 on the upper surface of the packing holding member 25. A trimmer 28 includes the combination of a stationary blade 28*a* and a movable blade 28*b*, and a coupling lug 28*c* is securely fixed to the movable blade 28*b*. The actuating arm portion 15*a* of the trimmer connector 15 is pivoted to the trimmer 28. A pair of small holes 28*d* are formed on the opposite ends of the trimmer 28, while, a pair of mating small projections 26*a* are formed on the inner side walls of the trimmer mounting frame 26, so that the trimmer 28 can swing around the small projections 26*a* fitted in the respective small holes 28*d*. In the operating position of the trimmer 28, the coupling lug 28*c* passes through a window 26*b* formed in the trimmer mounting frame 26 to engage the trimmer coupling member 17*c* formed on the oscillating rod 17*d* of the oscillator 17.

Referring specifically to FIGS. 1, 2, and 3, an inner blade supporting member 29 is mounted on the top of the oscillating rod 17*d* to support an inner blade member 30 having many small blades 30*a* implanted thereon. An outer blade frame 31 of die-cast aluminum is detachably mounted relative to the inner blade member 30 by the pop-up arms 23 and the anchoring arms 21*a*. An outer blade member 32 of net structure is detachably mounted on the outer blade frame 31. A pair of bosses 31*a* formed on the inner side walls of the outer blade frame 31 engage with mating recesses 23*b* formed on the outer sides of the pair of pop-up arms 23, so that the outer blade frame 31 is held in position by the pop-up arms 23.

Referring specifically to FIGS. 1, 2, and 4, a battery cover 33 openably closes the open lower end of the outer casing 1 and is composed of an inner cover member 34 and an outer cover member 35. A ring packing 36 is fitted in a mounting groove 34*c* formed on the outer periphery of the inner cover member 34, and an electrical connector 37 for the batteries 4 is press-fitted in the inner cover member 34. When the inner cover member 34 and the outer cover member 35 are assembled, a pair of engaging claws 38 are firmly interposed therebetween. Each of the engaging claws 38 includes a claw portion 38*a* and a pressurizing portion 38*b*. A pair of recesses 1*h* engageable with the respective claw portions 38*a* are formed on the inner surface of the lower end of the outer casing 1, and a pair of slots 35*a* are formed in the outer cover member 35, so that the respective pressurizing portions 38*b* can protrude outward therethrough. A generally U-shaped spring 39 is interposed between the inner cover member 34 and the outer cover member 35 for normally biasing the pressurizing portions 38*b* outward, and a pair of cavities 34*a* are formed on opposite side surfaces of the inner cover member 34 to leave spaces permitting free movement of the pressurizing portions 38*b*. An air port 34*b* are formed in the bottom surface of the inner cover member 34 so as to feed air therethrough during a watertightness test. A cylindrical rib 35*b* is formed on the inner bottom surface of the outer cover member 35 to hermetically close the air port 34*b* when the two cover members 34 and 35 are assembled.

The operation of the various parts of the apparatus of the present invention will now be described.

(A) Drive of the Inner Blade Member 30

The motor 3 is not driven when the switch knob 9 is in its neutral position. The motor 3 is driven at a high speed and a low speed when the switch knob 9 is moved upward and downward, respectively, in FIG. 1. More precisely, in response to the upward movement of the switch knob 9, the corresponding movement of the locking member 11*c* urges the small projection 10*a* of the rubber member 10 toward the switch contact strip 5*a*.

Consequently, the contact 5*b* is brought into contact with the conductive strip 7, and the current from the batteries 4 is supplied directly to the motor 3 without passing through the Schottky diode 40 to drive the motor 3 at the high speed, thereby causing high-speed reciprocatory sliding movement of the inner blade member 30 along the inner surface of the outer blade member 32. On the other hand, in response to the downward movement of the switch knob 9, the switch contact strip 6*a* is now urged by the small projection 10*b* of the rubber member 10 toward the conductive strip 7. Consequently, the contact 6*b* is now brought into contact with the conductive strip 7, and the current from the batteries 4 is supplied now through the Schottky diode 40 to drive the motor 3 at the low speed, thereby causing low-speed reciprocatory sliding movement of the inner blade member 30 along the inner surface of the outer blade member 32.

(B) Drive of the Trimmer 28

When the trimmer handle 14 is urged upward in FIG. 2 after moving the switch knob 9 upward or downward to drive the motor 3, the trimmer 28 is raised to the position higher than the horizontal by the function of the actuating arm portion 15*a* of the trimmer coupler 15. At the same time, the coupling lug 28*c* engages loosely with the recess or the trimmer coupling member 17*c* of the oscillating rod 17*d*, so that the reciprocatory oscillating movement of the oscillating rod 17*d* is transmitted to the movable blade 28*b* of the trimmer 28. Thus, depending on the high or low rotation speed of the motor 3, the movable blade 28*b* is driven at the high or low speed.

(C) Replacement of the Batteries 4

For replacement of the batteries 4, the battery cover 33 is detached from the lower end of the outer casing 1. Depression of the pressurizing portions 38*b* by hand causes disengagement of the claw portions 38*a* from the mating recesses 1*h*, thereby facilitating removal of the battery cover 33. The used batteries 4 are taken out and replaced by fresh ones. In the present invention, perforations 2*f* having shapes analogous to the contour of the batteries 4 and perforations 2*g* having shapes of ⊕ and ⊖ are formed at the lower part of the battery casing 2, as shown in FIG. 3, for illustration of the polarity of the batteries 4 to be inserted, so as to avoid the possibility of cell mismounting.

(D) Washing of the Inner Blade Member 30 and Trimmer 28

Upon moving the outer blade frame 31 away in parallel from the cover member 19, a shaving discharge gap is formed between the cover member 19 and the outer blade frame 31 around its entire periphery, thereby providing a safe and efficient mechanism for the removal of the shavings. More precisely, in response to the inward depression of the releasing push buttons 21, the anchoring arms 21 are first disengaged from the outer blade frame 31 to permit upward movement of the pop-up arms 23 by the force of the coil springs 24. Therefore, the outer blade frame 31 is popped up slightly upward while being engaged by the pop-up arms 23, so that a shaving discharge gap (not shown) can be formed between the cover member 19 and the outer blade frame 31 around its entire periphery. For the purpose of washing, the parts including the outer frame member 31, inner blade member 30, and trimmer 28 are immersed in water in the above state, and the inner blade member 30 is driven to remove shavings accumulated around the inner blade member 30 and the outer blade frame 31 through the above gap. Because of the fact that the shaving discharge gap is formed around the entire periphery, even a large amount of shavings can be quickly discharged, and also because of the fact that the apparatus is washed in the state in which the inner blade member 30 is substantially covered with the outer blade frame 31, the washing process can be done very safely.

Withdrawal of the outer blade frame 31 can be simply attained by pulling the outer blade frame 31 upward relative to the pop-up arms 23, thereby causing flexion and disengagement of the pop-up arms 23 from the outer blade frame 31. The trimmer 28 can also be effectively washed at the same time, since water flows freely through the window 26*b* formed in the trimmer mounting frame 26.

(E) Molding of the Outer Casing 1

The trimmer mounting frame 26 is separately molded and fixed to the outer casing 1 by the screws 27. Therefore, electric shaver apparatuses of the type not provided with the trimmer on the outer casing 1 can be manufactured in the same manner as those of the type provided with the trimmer on the outer casing 1, apart from a mere modification of the trimmer switch mounting section 13. Thus, the molding process of the outer casing can be simplified, and the mold-making cost can also be reduced.

(F) Watertightness Test

Watertightness is tested prior to the assembling of the battery cover 33. The lower open end of the outer casing 1, on which at least the cover member 19, oscillator 17, and starter switch knob 9 are mounted in sealed relation, is closed by the inner cover member 34, and, after immersing the outer casing 1 in water, air at a suitable pressure is fed into the internal space of the outer casing 1 through the air port 34*b* provided for watertightness testing purpose. Confirmation is then made as to whether air bubbles emerge from the outer surface of the outer casing 1.

For the product which has been proved to be watertight by the watertightness test, the inner cover member 34 is fitted in the outer cover member 35 to conceal the air port 34*b*, and assembling of the battery cover 33 is thus completed. After mounting all of the remaining necessary ports, the completed products are conveyed to be packaged and stored in a warehouse to await for shipment.

We claim:

1. A washable electric shaver, which comprises:

an outer casing, the outer casing defining a watertight compartment in the interior of the casing and including an upper portion;

a motor housed within the watertight compartment of the outer casing;

an oscillator at least partially housed within the watertight compartment, the oscillator being operatively coupled to the motor, the oscillator including an oscillating rod extending through a watertight opening formed in the upper portion of the casing;

an inner blade member mounted on the oscillating rod, the inner blade member including a plurality of inner blades, each inner blade having an outer edge;

an outer blade frame, the outer blade frame including an outer blade member, the outer blade frame being positionable relative to the inner blade member so that the outer edges of the inner blades slidingly engage the outer blade member;

the outer blade frame being longitudinally movable relative to the upper portion of the outer casing between a first position, wherein the outer blade frame is closely positioned adjacent to the upper portion of the outer casing, and a second position, wherein the outer blade frame is supported in a raised position above and substantially parallel to the upper portion of the casing to facilitate cleaning the shaver, the outer blade frame and the upper portion of the casing defining a gap therebetween when the outer blade frame is in said second position;

means for supporting the outer blade frame in said second, raised position above and substantially parallel to the upper portion of the casing;

means for biasing and effecting the longitudinal movement of the outer blade frame from said first position to said second position;

means for selectively activating the biasing and movement effecting means, the activating means being controllable by the user of the shaver;

means for limiting the longitudinal movement of the outer blade frame between the first position and the second position; and means for selectively retaining the outer blade frame to the supporting means.

2. A washable electric shaver as defined by claim 1, wherein the means for supporting the outer blade frame in the second raised position includes a pair of arms mounted on the casing and longitudinally movable relative thereto; wherein the outer blade frame includes an inner wall surface; and wherein the means for selectively retaining the outer blade frame to the supporting means includes a recess formed on a surface of each arm, and bosses protruding from the inner wall surface of the outer blade frame and positioned on the inner wall surface to engage the recesses of the arms.

3. A washable electric shaver as defined by claim 2, wherein the means for biasing and effecting longitudinal movement of the outer blade frame includes a pair of coil springs, each spring being disposed between the casing and a respective arm to effect movement of the arms from the casing.

4. A washable electric shaver as defined by claim 2, wherein the means for limiting the longitudinal movement of the outer blade frame between the first position and the second position includes a pair of projections mounted on the casing upper portion, and a pair of flanges mounted on the arms, each of the flanges being engageable with the corresponding projection to limit the movement of the outer blade frame with respect to the casing.

5. A washable electric shaver as defined by claim 4, which further comprises trimmer means mounted on the casing.

6. A washable electric shaver as defined by claim 5, wherein the outer casing further defines a battery accommodation compartment watertightly communicating with the watertight compartment housing the motor; and wherein the casing further includes an end cover mounted thereon, the end cover including an inner cover, and an outer cover watertightly mounted on the inner cover, the inner cover including a test hole formed through its thickness and communicating with the battery accommodation compartment, the outer cover having a projection closely received by the hole of the inner cover.

7. A washable electric shaver as defined by claim 1, wherein the means for selectively activating the biasing and movement effecting means includes a pair of user controllable push buttons movably mounted on the casing, the push buttons being operatively coupled to the outer blade frame to selectively engage the outer blade frame, whereby the outer blade frame is retained in the first position, and to be selectively disengaged from the outer blade frame, whereby the movement effecting means is activated to effect movement of the outer blade frame from the first position to the second position.

8. A washable electric shaver as defined by claim 1, which further comprises trimmer means mounted on the casing.

9. A washable electric shaver as defined by claim 8, wherein the outer casing further defines a battery accommodation compartment watertightly communicating with the watertight compartment housing the motor; and wherein the casing further includes an end cover mounted thereon, the end cover including an inner cover, and an outer cover watertightly mounted on the inner cover, the inner cover including a test hole formed through its thickness and communicating with the battery accommodation compartment, the outer cover having a projection closely received by the hole of the inner cover.

10. A washable electric shaver as defined by claim 8, wherein the trimmer means includes a trimmer mounting frame mounted on the casing, a trimmer member mounted on the mounting frame and pivotal thereon between a trimmer operating position and a trimmer non-operating position, and a movable blade mounted on the trimmer member and operatively coupled to the oscillating rod.

11. A washable electric shaver as defined by claim 10, wherein the trimmer means further includes a trimmer mounting section formed as an upward extension of the casing; a trimmer handle movably mounted on the trimmer mounting section; and coupling means for operatively coupling the handle to the trimmer member whereby movement of the handle effects movement of the trimmer member between the trimmer operating position and the trimmer non-operating position.

12. A washable electric shaver as defined by claim 1, wherein the outer casing further defines a battery accommodation compartment watertightly communicating with the watertight compartment housing the motor; and wherein the casing further includes an end cover mounted thereon, the end cover including an inner cover, and an outer cover watertightly mounted on the inner cover, the inner cover including a test hole formed through its thickness and communicating with the battery accommodation compartment, the outer cover having a projection closely received by the hole of the inner cover.

* * * * *